US006343450B1

(12) United States Patent
Vance, Jr.

(10) Patent No.: US 6,343,450 B1
(45) Date of Patent: Feb. 5, 2002

(54) SNAP-TOGETHER CEILING DRAINAGE SYSTEM FOR DECKS AND CANOPIES

(76) Inventor: Robert L. Vance, Jr., 3329 Rockingham Rd., Greensboro, NC (US) 27407

( * ) Notice: Subject to any disclaimer, the term of this patent is extended or adjusted under 35 U.S.C. 154(b) by 5 days.

(21) Appl. No.: 09/591,173

(22) Filed: Jun. 9, 2000

Related U.S. Application Data

(60) Provisional application No. 60/139,446, filed on Jun. 16, 1999.

(51) Int. Cl.[7] ..... E04B 1/70; E04F 17/00; E04F 17/04; E04F 17/08

(52) U.S. Cl. ..... 52/302.1; 52/11; 52/127.5; 52/462; 52/478

(58) Field of Search ..... 52/11, 127.5, 462, 52/478, 302.1; 405/118, 119

(56) References Cited

U.S. PATENT DOCUMENTS 4,065,883 A 1/1978 Thibodeau
4,129,967 A * 12/1978 Barlow ..... 52/15
4,663,894 A * 5/1987 LaRoche et al. ..... 52/15
4,860,502 A 8/1989 Mickelsen
5,511,351 A 4/1996 Moore
5,765,328 A 6/1998 Moore
6,164,019 A * 12/2000 Salley ..... 52/11
6,226,956 B1 * 5/2001 Davis et al. ..... 52/745.06

* cited by examiner

*Primary Examiner*—Beth A. Stephan
*Assistant Examiner*—Dennis L. Dorsey
(74) *Attorney, Agent, or Firm*—Thomas, Kayden, Horstemeyer & Risley LLP

(57) ABSTRACT

The present invention provides a ceiling drainage system for decks, canopies and other applications acting under a similar operational environment. The system is designed to attach to the underside of a conventional structural framework such as an outdoor house deck or a stand-alone canopy. The system provides a watertight snap-together ceiling that keeps the underneath area dry as to create outdoor living or storage space. The multi-paneled ceiling system is unique with its all-plastic construction and its multi-functional watertight snap-fitting interlock feature. This snap-feature maintains a watertight joint between adjacent components while allowing for thermal expansions and contractions of the modular plastic componentry and the inherent movements of the supporting structural framework. This system given its simplicity provides a superior "do-it-yourself" installation procedure for the unskilled homeowner or builder. With this approach, no caulking, sealants or overlapping panel geometry is required to produce a secure weatherable ceiling system as other deck drainage systems dictate.

25 Claims, 6 Drawing Sheets

A-A
Bottom of Deck
D1
10, Joist
1, Main Stringer
3, Ceiling Panel
10, Framework
2, Main Cap
9, Fastener
7, Gutter
9, Fasteners
8, Seals
11
6, Splash Guards
3, Ceiling Panel
7, Gutter
9, Fastener
B B
TOP VIEW OF DECK
A
B
20
21
24
25
26

SNAP-TOGETHER CEILING DRAINAGE SYSTEM FOR DECKS AND CANOPIES

This Appln. claims benefit of Prov. No. 60/139,446 filed Jun. 16, 1999.

BACKGROUND OF THE INVENTION

A number of different deck drainage systems have been developed to provide overhead water capturing and drainage. Such systems as U.S. Pat. Nos. 5,765,328 & 5,511,351 to Moore, U.S. Pat. No. 4, 065,883 to Thibodeau, and U.S. Pat. No. 4,860,502 to Mickelsen, are specifically designed only for the use with outdoor decks. Their designs do not utilize a simple snap-together modular plastic componentry system to accommodate a quick, easy and secure watertight installation to the unskilled "do-it-yourself" homeowner or builder. These designs consist of metal componentry systems that require the use of sealants and caulkings to yield watertight assembly joints. This type of assembly and installation requires time-consuming skilled techniques with susceptibility to joint malfunctions and deterioration from thermal and vibrational elastic movements. Another problem with these systems is that they require the overhead water capturing panels to be tilted to a specific angle to provide proper water drainage or run-off as opposed to this invention in which the ceiling system is positioned level to the supporting structural framework. Tilting demands skilled workmanship and measurement which does not promote a quick, easy and secure method of installation. Metal componentry systems also do not provide resistance to deformation from localized impact loading as do the durable plastic components. Being that these patented systems are specifically designed for decks they do not provide for multi-functional uses to accommodate utilities such as stand-alone shelters or canopies. This invention is designed to encompass this utility by its weatherable all-plastic multi-paneled convexing or arched geometry, as opposed to existing specifically deck designed systems which utilize concave or flat panel configurations. These patented concave and flat-panels array systems do not combine inherent load bearing geometry with a weatherable polymer material as to provide acceptance to direct impact or impingement and exposure to extreme weather conditions such as heavy rainfall, hail storms, turbulent winding and winter ice-laden conditions.

BRIEF SUMMARY OF THE INVENTION

The present invention provides a ceiling drainage system for decks, canopies and other applications acting under similar operational environment. The system is designed to attach to the underside of a conventional structural framework such as an outdoor house deck or a stand-alone sheltering canopy. Its function is to provide a watertight snap-together ceiling system that collects and drains impinging rainwater overhead thereby securing a dry outdoor living or storage space below. Its benefits reside in its unique modular "do-it-yourself" assembly simplicity due to its snap-together design, multi-applicational utilization, its all-plastic construction, its level attachment scheme to the structural framework, and its use of inherent load-bearing geometry. All of these attributes unite to create an efficient watertight ceiling system that will withstand direct impingement and exposure to harsh weathering conditions such as heavy rainstorms, hail storms, turbulently wind gusts and winters heavy icing.

This invention comprises modular components manufactured of weatherable grade polymer material. The snap together components include the Stringers (Main & End), also referred to as main housing members, Caps (Main & End), Ceiling Panels and Splash Guards. The polymer material can withstand substantial impact loading without permanent deformation, possess styling surface texture on visible surfaces, is user friendly and easy to work with, and is inherently lightweight.

The backbone of this invention resides in its unique multi-functional snap-fitting interlock design feature. This multi-functional feature permits the integration of watertight self-sealing joints between adjacent componentry, allows for thermal expansions and contractions of the modular plastic componentry and the inherent movements of the supporting structural framework, and yields a superior "do-it-yourself" installation for the unskilled homeowner or installer. With this approach, no sealants, caulking or overlapping panel geometry is necessary, no skilled installation techniques are required, and there are no limitations for utility applications to create a secure watertight ceiling system.

Given its collective design attributes, this unique water drainage ceiling system may serve multiple utilitarian functions, for example, its use for creating a directly exposed canopied shelter fastened to an independent structural framework. In this function, the snap-together watertight ceiling system provides a quick to install durable overhead shelter for boats, automobiles, lawn equipment, and material storage. This utility versatility is very useful to the non-skilled "do-it-yourself" homeowner or builder. It inherently offers a simple and economic means of providing additional outdoors dry useable space while also expressing a look of elegance with its multi-cathedral ceiling panel geometry.

Other features and advantages of the present invention will become apparent to one with skill in the art upon examination of the following drawings and detailed description. It is intended that all such additional features and advantages be included herein within the scope of the present invention.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals along with individual component naming designate corresponding parts throughout the several views.

Figure 4:
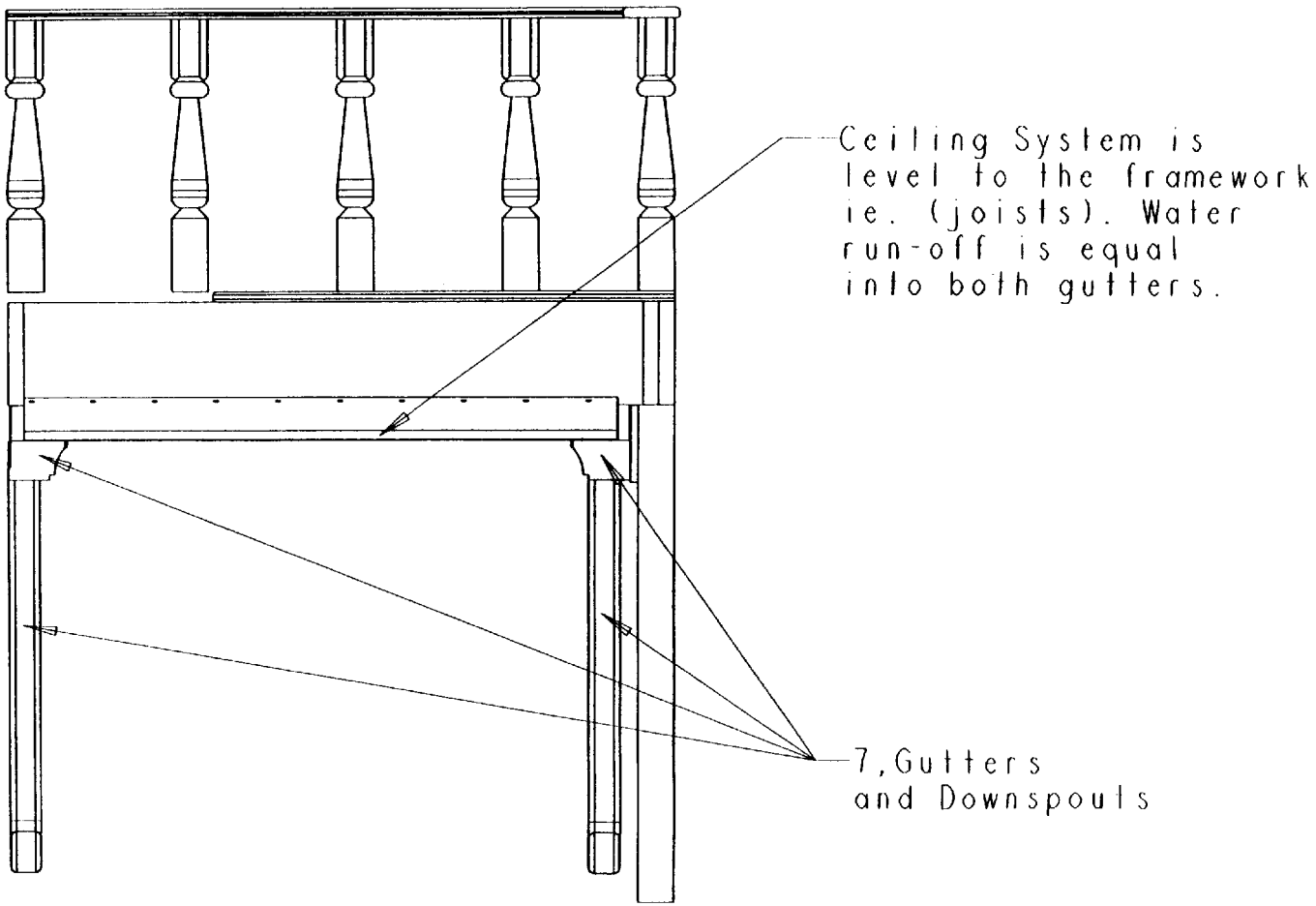

FIG. 4 presents an isometric view of the ceiling system utilized in the application as a direct canopy shelter. The system is attached to a stand-alone supporting framework. Acting as a canopy, the ceiling system is directly impinged by the weathering elements above.

Figure 5:
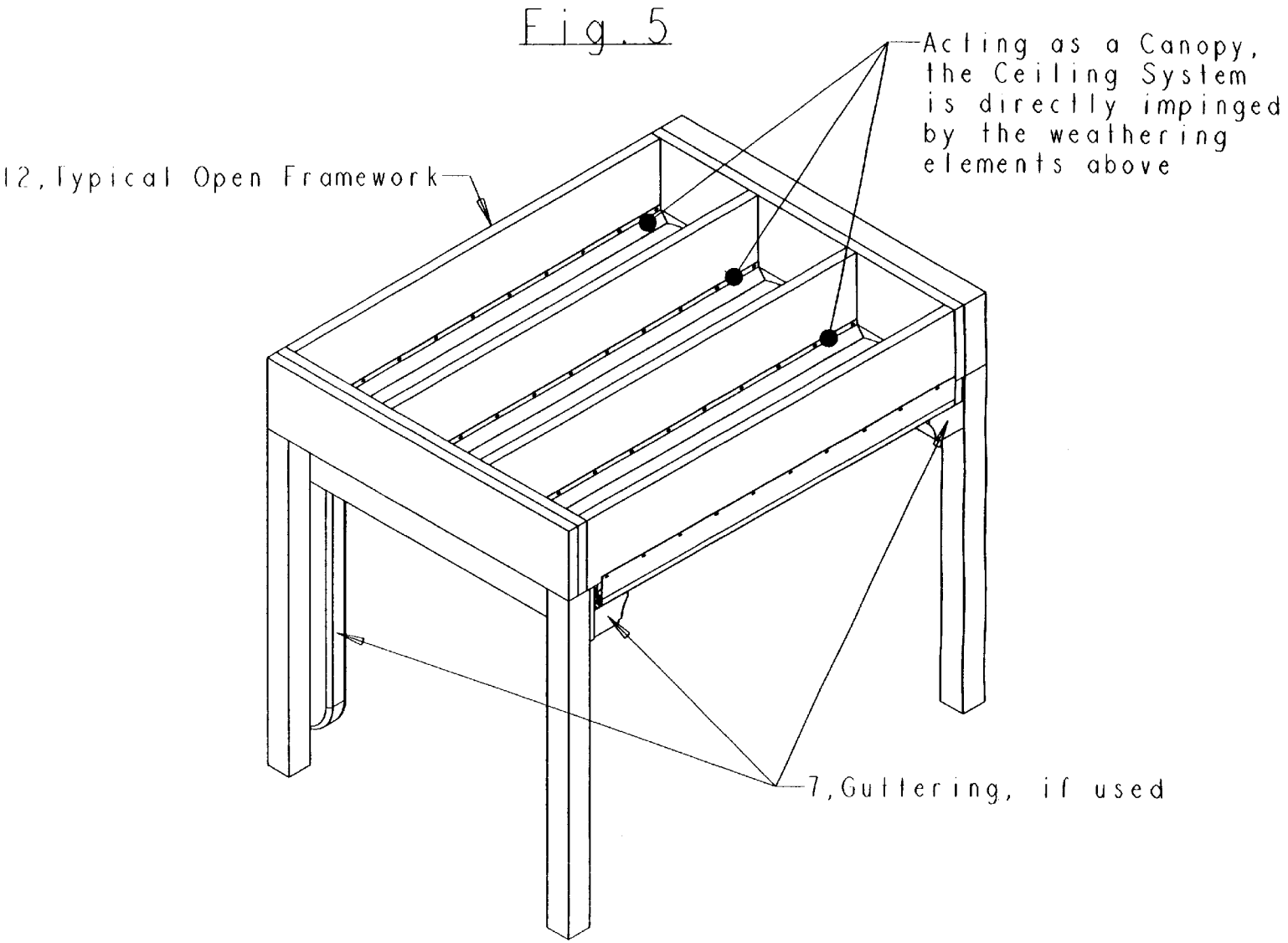

FIG. 5 is an elevation view of the Snap-Together Ceiling Water Drainage System fastened to a typical deck framework in the orientation as Method 1. The purpose of this view is to show that the ceiling system is level to the supporting framework. Note: The tilting of the ceiling system is this invention is not necessary for water drainage or run-off.

DETAILED DESCRIPTION OF THE PREFERRED EMBODIMENT

Figure 1A:
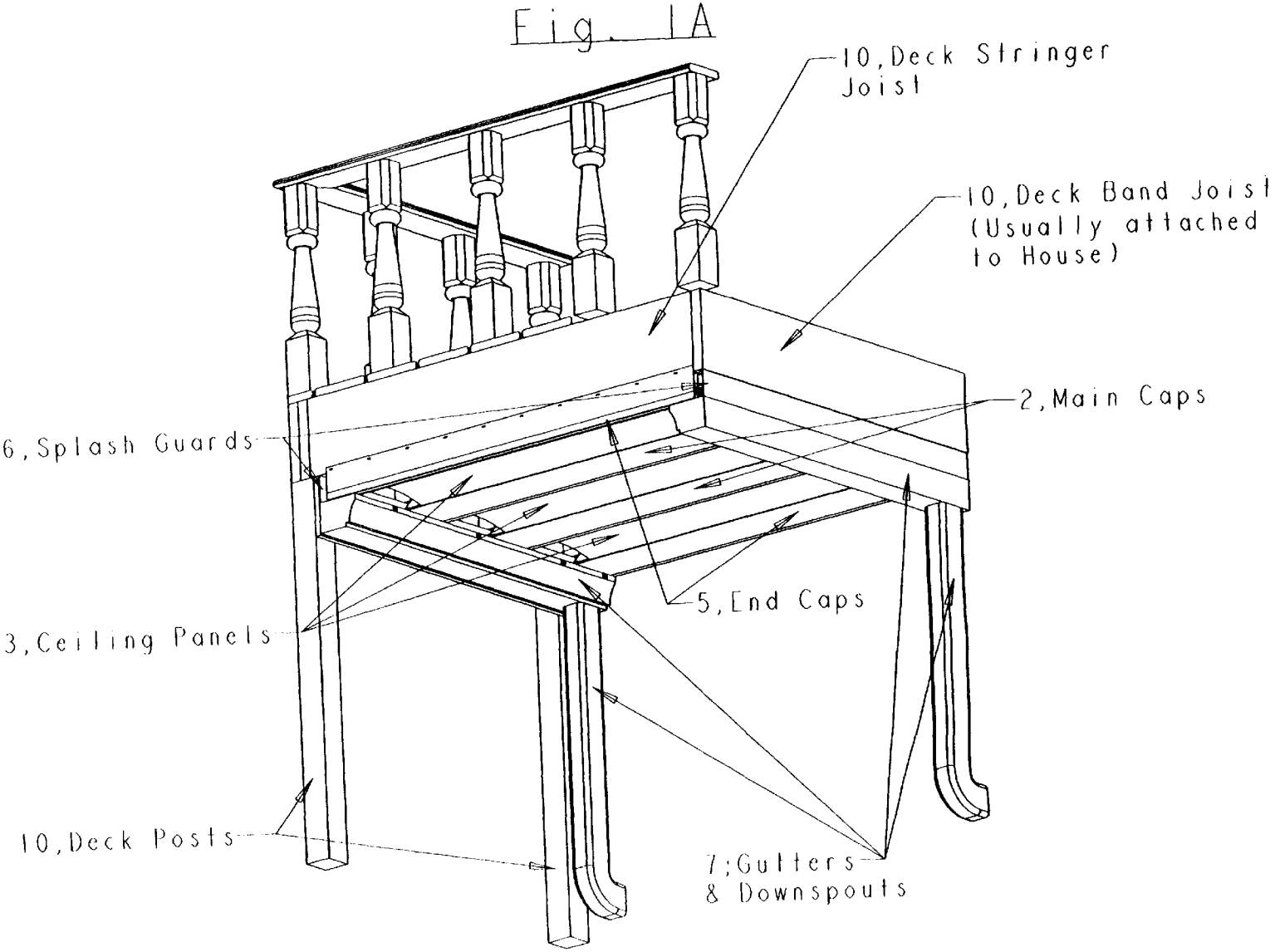
FIGS. 1A and 1B show condensed isometric views of a typical conventional deck framework displaying the all-plastic ceiling system componentry. These figures demark Method 1 ceiling system attachment to a typical house attached deck. Method 1 adapts the ceiling drainage system to lie parallel and attach directly to the deck joists.
Figure 1B:
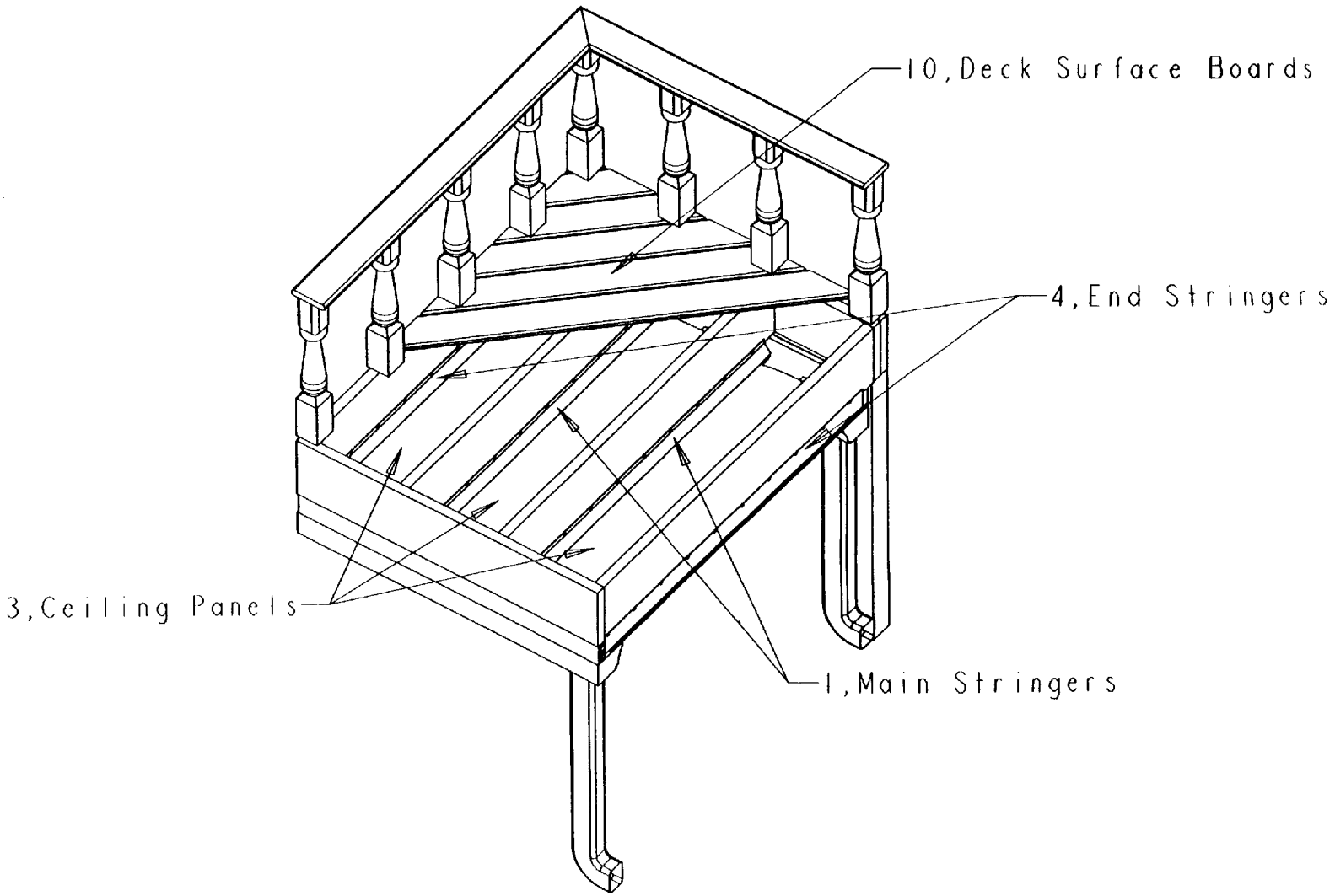

The Snap-Together Ceiling Drainage System for Decks and Canopies comprises of a plurality of different plastic components shown in FIGS. 1A & 1B; main stringer 1, main cap 2, ceiling panel 3, end stringer 4, end cap 5, and splash guard 6. FIGS. 1A & 1B present the ceiling system attached to a conventional outdoors residential deck in orientation Method 1. Methods are denoted in the Description of Drawings section above. The stringers 1 & 4 and the splash guards 6 are the only components of the ceiling system that are attached to the supporting structural framework 10. The top of the convexed or arched ceiling panels 3 are just below the bottom of the structural framework 10 as seen in section A—A from FIG. 2. These components are fastened to the framework 10 using nails/screws 9, as indicated in section A—A & B—B. The ceiling panels 3 and caps 2 & 5 are fully retained by the stringers 1 & 4.

Figure 2:
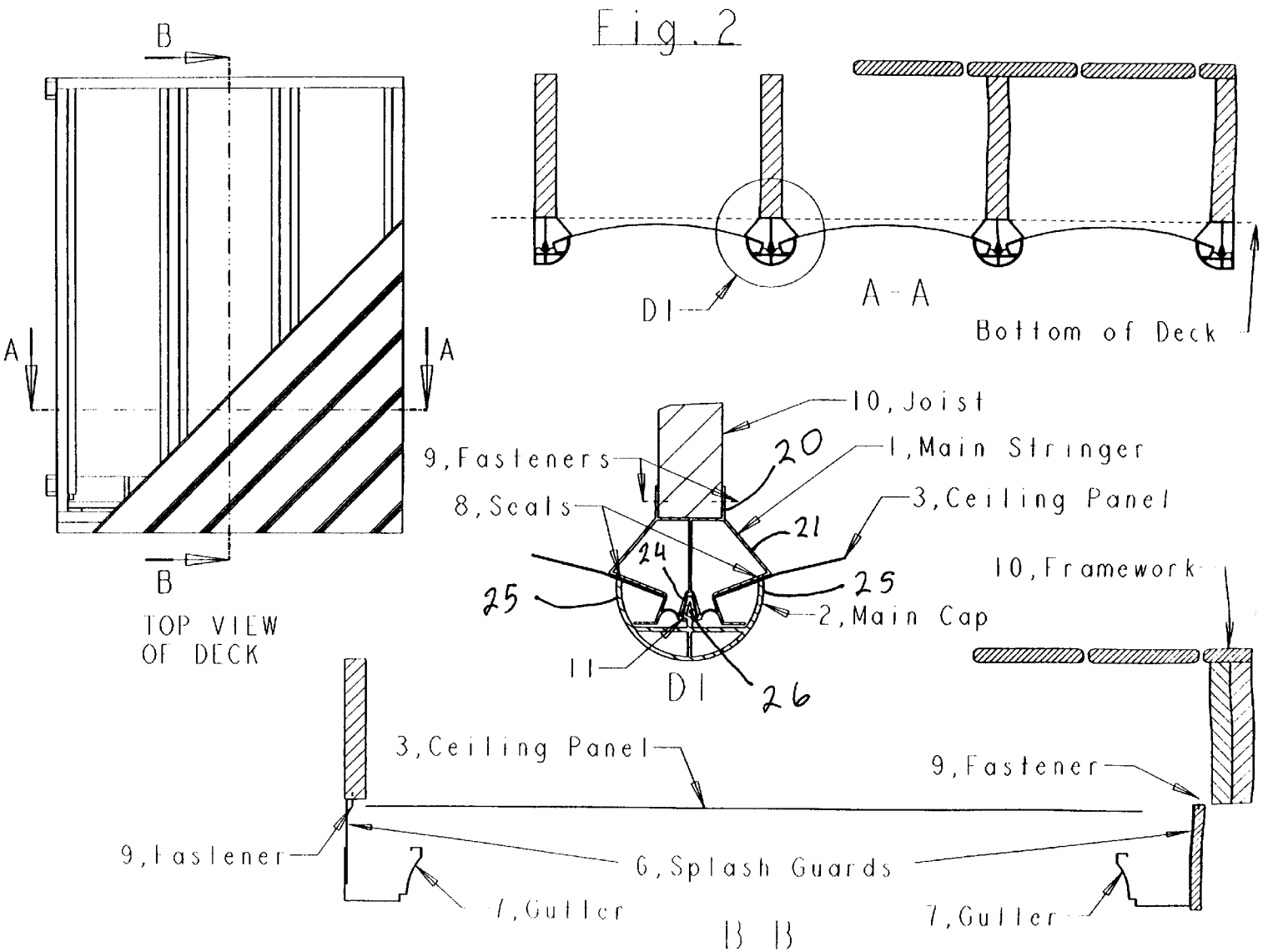
FIG. 2 depicts cross-sectional views of the ceiling system attached also to a deck framework. Section A—A presents the convexing or individually arched ceiling panel geometry in functioning position, being retained on each side by a main stringer and cap set. Seen in an end of framework condition, the ceiling panel is retained only on one side by an end stringer & cap set. Detail view D1 from Section A—A depicts the multi-functional watertight snap-interlock design feature. Section B—B shows the positioning of the splash guards, ceiling panel and guttering for Method 1 relative to the decks framework.

Referring to FIG. 2, stringer 1 includes a fastening portion 20, at least one side wall 21, at least one inner wall 22, and snap lock/unlock 24. The fastening portion 20 is generally configured to be U-shaped having a flat bottom and being wide enough to receive a portion of the longitudinal length of a joist for fastening thereto. A side wall 21 extends down and out from an edge of the fastening portion 20. Inner wall 22 extends down and in from the of side wall 21 distal from fastening portion 20 and has a flexible/compressible seal 8 attached thereto. Extending generally downward beneath fastening portion 20 is snap lock/unlock 24 which is also connected to inner wall 22. Inner side wall 22 includes a hook like portion configured to receive an edge of a ceiling panel 3. Snap lock/unlock 24 defines an opening for receiving a coupling head of cap 2.

Cap 2 includes at least one side wall 25 for compressing a portion of a ceiling panel against a flexible/compressible seal 8 and a coupling head 26. Coupling head 26 is configured to be received by snap lock/unlock 24. When coupling head 26 is coupled with snap lock/unlock 24 side wall 25 presses against a portion of ceiling panel 3 thereby pressing ceiling panel 3 against flexible/compressible seal 8.

The multi-functional snap-together watertight interlocking feature of the system is presented in Detail D1 in FIG. 2. This self-sealing interlocking feature is the backbone of the design structure. It captures the ceiling panels 3 longitudinally, one on each side of the main stringer 1 component, which are then tightly sandwiched by the hemispherical cap 2 component snap-locking into the stringer 1. The same feature exists at the ends of the ceiling system, except only one edge of a ceiling panel 3 is captured longitudinally and snap-locked in by the end cap 5 as viewed in section A—A. The sandwiched ceiling panels 3 combine with the integral stringer 1,4 seals 8 to provide the unique watertight sealing joints while also allowing for necessary thermal expansions and contractions of the plastic components and the flexural movements of the supporting framework 10 while still retaining the watertight seal joint. Any seepage of water that may escape through the joint seals 8 is captured by the cap components 2 & 5, and is also channeled away into the gutters 7. The water and debris that is channeled to the gutters 7 follows the "V" shape that is created between the convexing ceiling panels 3 and the side walls of the stringers 1 & 4 as depicted in section A—A and Detail D1. Because of this watertight self-sealing snap-feature no additional caulking, sealants or overlapping panel geometry is required to provide watertight joints between adjacent components as other systems dictate. The snap interlock feature is produced by the engagement of the arrowhead shaped feature of the cap component 2 & 5 into the receiving locking feature of the stringer component 1 & 4. This positive locking snap-in-place design also provides an integrated "un-snapping" function that is supplied by the arrowheads lower upward angled surface 11. This function is to provide for ease of disassembly if needed. The integral stringer seals 8 are comprised of a soft closed cell sponge-like or bulb-type sealing material. During the snap-fitting of the cap 2 & 5 into the stringer 1 & 4 this material undergoes compression with the ceiling panels 3 sandwiched in-between.

The caps 2 & 5, stringers 1 & 4, and the splash guards 6 are pre-molded into their designed shapes using a weatherable grade polymer. The ceiling panels 3 are flat sheets of the same polymer bowed or arched convexly into their functional position, section A—A. This geometric configuration provides inherent load bearing strength to withstand impinging weather conditions from heavy rainwater, wind turbulations or ice accumulation. Another advantage with the all-plastic construction is that the visible ceiling panels 3 and caps 2 & 5 may be molded with styling texture and color. This ceiling systems use of the splash guards 6, and gutters 7 are self-explanatory, see all Figs, noting that the channeled draining water displaced by the ceiling system splashes onto the splash guards 6 and falls into the gutters 7 which collect and discard the water.

Figure 3:
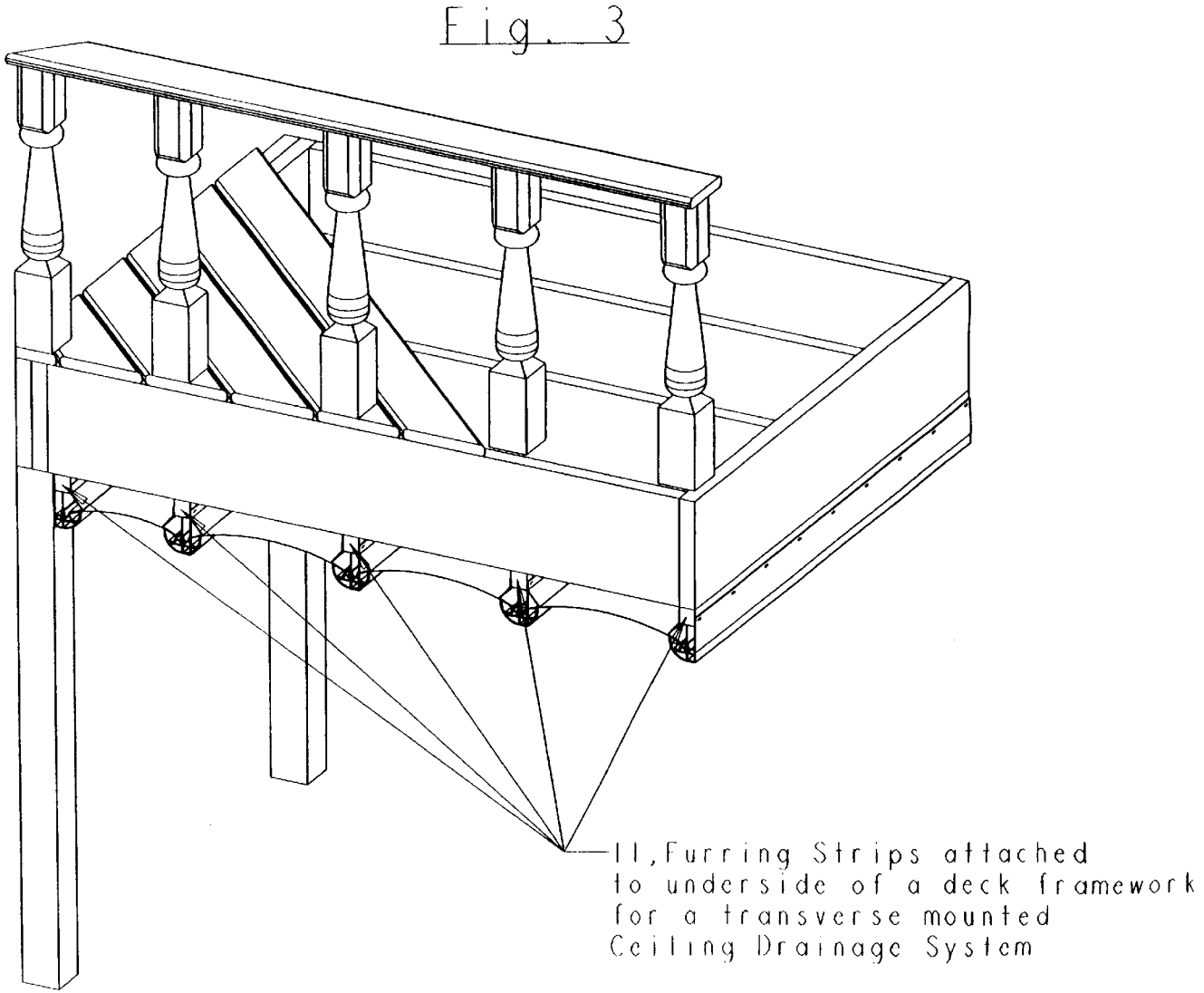
FIG. 3 presents an isometric view of Method 2 ceiling system attachment also to a deck framework. Method 2 deploys the use of additional furring strips attached directly to the bottom of the deck framework to support and fasten the stringers. This configuration positions the ceiling system to lie perpendicular to the deck joists transversely to Method 1 orientation.

The ceiling system assembly is designed to provide the "do-it-yourself" non-skilled homeowner or builder a quick, easy and fault-free installation. This is due to the entire manifestation of the assembly design itself. The installation begins with the stringers 1 & 4, which effectively align all other componentry except the spash guards 6. The stringers 1 & 4 are set directly to the bottom of the joists of the supporting framework 10 and fastened through their extension flanges to the sides of the joist using nails or screws as shown in Detail D1 FIG. 2. The ceiling system is level to the framework, there is no prescribed slope to any of the systems plastic components to provide for water drainage or run-off as shown in FIG. 3. The stringers 1 & 4 are cut to the joist lengths to accommodate varying framework configurations. The splash guard 6 components are next to be installed and are fastened to the bottom of the band joists at both ends of the framework as shown in section B—B FIG. 2. The splash guards 6 deflect the ceiling systems draining water directly into the gutters 7, section B—B. After all stringers 1 & 4 are in place the ceiling panels 3 are then bowed or arched upward in-between the adjacent stringers 1 & 4 effectively snapping them into their tentative position.

This geometry creates an appearance of an arrayed "cathedral" ceiling FIG. 2. Using a rubber mallet, the cap's arrowheads 2 & 5 are then snapped into the stringers locking mechanism 1 & 4 simultaneously pinching the thin ceiling panels tight against the integral stringer seals 8, Detail D1 FIG. 2. For decks with a narrow end joist condition, the ceiling panel 3 is trimmed to appropriate width. The final step in the installation is the gutters and downspouts 7, one set usually located at either end of ceiling system, pitched to provide proper water drainage and disposal. The gutters 7 are attached to the framework 10 and/or the house wall in the application of a residential deck.

The components modularity in conjunction in the prescribed design features as stated above provides for universal deck and canopy framework attachment configurations. Because of this versatility, this ceiling system may be used in various operational environments or applications as in FIGS. 1 & 5. Different mounting Methods to these various frameworks as example in FIG. 3 present a universal Ceiling Drainage System utility. FIG. 3 shows additionally placed furring strips 11 to demonstrate a simple transverse mounted ceiling system relative to the configuration as seen in FIGS. 1A & 1B. The stringer components 1 & 4 may capture typical joists or these additionally placed furring strips 11 for just about any framework configuration. A simple trim-to-fit of the plastic componentry provides the required versatility for any component to fit all typical or angular supporting framework configurations.

It should be emphasized that the above-described preferred embodiment of the present invention is merely a possible state example of an implementation, merely set forth for a clear understanding of the principles of the invention. Many variations and modifications may be made to the above-described embodiment of the invention without departing substantially from the spirit and principles of the invention. For example, ends of the hemi-spherical caps could have the stringer seal material disposed thereon so that a seal is formed between the ceiling panel and the hemi-spherical cap. In other embodiments, the caps and the stringers could be coupled by screws. All such modifications and variations are intended to be included herein within the scope of the present invention.

I claim:

1. A draining system for channeling and draining water, said draining system comprising:

a plurality of joists arranged generally parallel and equally spaced;

a plurality of stringers arranged generally parallel, each of said stringers having a fastening portion, a means for receiving an edge of a ceiling panel, and means for receiving a coupling head, wherein said fastening portion receives a portion of said joist and is rigidly fastened thereto, and wherein said stringer having a longitudinal length extending substantially beneath said joist from a first end to a second end;

a plurality of ceiling panels, each of said ceiling panels having opposed edges received by said panel receiving means of adjacent stringers, said ceiling panels extending substantially along the longitudinal length of said stringers; and a plurality of caps, each of said caps having at least one compression wall and a coupling head, said coupling head configured to be received by said coupling head receiving means, wherein when said coupling head is received by said coupling head receiving means said compression wall presses a portion of each ceiling panel received by said ceiling panel receiving means against a portion of said ceiling panel receiving means.

2. The draining system as claimed in claim 1, wherein said ceiling panels receiving means are configured to receive an edge of a first ceiling panel and an edge of a second ceiling panel.

3. The draining system as claimed in claim 2, wherein each of said ceiling panels are bowed upward such that said opposed edges of said ceiling panels are lower than the bowed portion of said ceiling panels.

4. The draining system as claimed in claim 3, wherein each of said stringers and each of said caps are coupled by pressing said coupling head into said coupling head receiving means.

5. The draining system as claimed in claim 4, wherein each of said stringers and each of said caps are decoupled by pulling said coupling head out of said coupling head receiving means.

6. The draining system as claimed in claim 5 further including:

a compressible material disposed on said ceiling panel receiving means, wherein said compressible material is compressed between said ceiling panel and said ceiling panel receiving means when said coupling head is received by said coupling head receiving means.

7. The draining system as claimed in claim 6 further including:

a band joist affixed to said plurality of joists;

at least two posts for supporting said plurality of joists;

a splash guard rigidly affixed to said band joist, said splash guard proximal to said first end of said stringers;

a gutter affixed to said posts beneath said splash guard, said gutter extending under a portion of said stringers and said ceiling panels, wherein water channeled by said ceiling panels is received by said gutter; and a down spout affixed to said gutter for draining water from said gutter.

8. A water draining system for channeling and draining water, said draining system comprising:

a plurality of main housings arranged generally parallel beneath a frame, said main housings having means for fastening to a support, means for receiving at least one ceiling panel, and means for receiving a coupling head;

a plurality of ceiling panels, said ceiling panels each having opposed edge portions received by adjacent ceiling panel receiving means; and a plurality of caps, said caps each having a compression surface and a coupling head, wherein said coupling heads are interlocked with said coupling head receiving means.

9. The water draining system as claimed in claim 8, wherein said ceiling panels are formed from a flexible material and each is arched upward such that the opposed edges are lower than the peak of the arch.

10. The draining system as claimed in claim 9, wherein said main housings and said caps are interlocked by pressing said coupling head into said coupling head receiving means.

11. The draining system as claimed in claim 10, wherein said main housings and said caps are de-interlocked by pulling said coupling head from said coupling head receiving means.

12. The draining system as claimed in claim 11 further including:

a compressible material disposed on said ceiling panel receiving means, wherein said compressible material is compressed between said ceiling panel and said ceiling panel receiving means when said coupling head is interlocked with said coupling head receiving means.

13. The water draining system as claimed in claim 12, wherein the fastening means receives a portion of a joist of a frame for fastening thereto.

14. The water draining system as claimed in claim 13, wherein the fastening means receives a portion of a furring for fastening thereto, and wherein said furring is affixed to the underside of a frame.

15. A process of installing a drainage system underneath a frame assembly, the method comprising the steps of:

securing to the bottom of a frame a plurality of main housing members, each main housing member having a longitudinal length extending beneath a frame and the main housing members arranged substantially parallel;

placing a ceiling panel between adjacent main housing members, wherein said ceiling panel is formed from a generally rectangular flexible material having a length approximately equal to the longitudinal length of the main housing member and opposed edges with a width greater then the distance between the adjacent main housing members; and securing said opposed edges of said ceiling panel to said adjacent main housing members.

16. The method as claimed in claim 15, wherein each of said main housing members includes a means for receiving a coupling head, and a means for receiving a plurality of caps, and each of said caps includes a coupling head configured to be received by said coupling head receiving means; and the step of securing opposed edges of said ceiling panel to said adjacent main housing members further includes:

interconnecting said caps to said adjacent main housing members by pressing said coupling heads into said coupling head receiving means.

17. The method as claimed in claim 16, wherein said ceiling panel is arched upward with said opposed edges forming the lowest portion of the arch.

18. The method as claimed in claim 17, wherein said coupling head and said coupling head receiving means are configured to be separable.

19. A draining system for mounting to the underside of a deck-like frame, the draining system for channeling and collecting water passing through a deck-like frame, the system comprising:

at least two stringers aligned generally parallel extending beneath a frame, each stringer having an fastening portion, a snap lock/unlock, at least one upper side wall, and at least one lower side wall, said fastening portion configured for fastening to a portion of a joist of a frame, said at least one upper side wall extending from said fastening portion at a first angle in a first direction, said at least one lower side wall extending from said upper side wall at a second angle in a second direction, and said snap lock/unlock extending from said fastening portion, wherein said snap lock/unlock defines an opening for receiving a coupling head;

at least one ceiling panel having opposed edges, said ceiling panel extending between said lower walls of adjacent stringers;

at least two caps, said caps extending beneath said stringers, each of said caps having a coupling head and at least one compression wall, said coupling head configured to be received by said snap lock/unlock, wherein said compression wall presses a portion of said ceiling panel against a portion of said lower wall when said coupling head is received by said snap lock/unlock.

20. A draining system as claimed in claim 19, wherein said ceiling panel is bowed upward such that the highest portion of the ceiling panel is between adjacent stringers.

21. A draining system as claimed in claim 20, wherein said fastening portion of said stringer is generally U-shaped.

22. A draining system as claimed in claim 21, wherein said snap lock/unlock and coupling head are configured to be coupled by pressing said coupling head into said snap lock/unlock.

23. A draining system as claimed in claim 22, wherein said snap lock/unlock and coupling head are configured to be decoupled by pulling said coupling head out of said snap lock/unlock.

24. A draining system as claimed in claim 23, wherein said ceiling panels are formed from a flexible material and are bowed upward.

25. The draining system as claimed in claim 24 further including:

a compressible material disposed on said at least one lower side wall, wherein said compressible material is compressed between said ceiling panel and said at least one lower side wall when said coupling head is received by said snap lock/unlock.

* * * * *